United States Patent [19]

Tishkov et al.

[11] 4,003,831

[45] Jan. 18, 1977

[54] VIBRATION SCREEN

[76] Inventors: Anatoly Yakovlevich Tishkov, ulitsa Derzhavina, 19, kv. 67; Sergei Alexandrovich Fedorov, ulitsa 20 Partsiezda, 12, kv. 21; Anatoly Markovich Freidin, ulitsa Ippodromskaya, 31, kv. 9, all of Novosibirsk; Mikhail Zakharovich Latyshev, ulitsa Arsenieva, 98, kv. 20, Primorsky krai, Kavalerovsky raion, poselok Kavalerovo; Vitaly Markovich Grigoriev, ulitsa Tankovaya, 49, kv. 7, Novosibirsk; Jury Alexeevich Menshikov, ulitsa Arsenieva, 128, kv. 60, Primorsky krai, Kavalerovsky raion, poselok Kavalerovo; Andrei Andreevich Bovin, ulitsa 20 Partsiezda, 12, kv. 24, Novosibirsk; Vladimir Isaakovich Kreimer, ulitsa Voskhod, 7, kv. 73, Novosibirsk; Viktor Ananievich Chekushkin, ulitsa Zorge, 255, kv. 28, Novosibirsk; Vladimir Petrovich Lumpov, ulitsa Gorskaya, 41, Novosibirsk; Dmitry Semenovich Alexeev, ulitsa Novogodnaya, 38, kv. 51, Novosibirsk, all of U.S.S.R.

[22] Filed: Sept. 20, 1974

[21] Appl. No.: 507,981

[52] U.S. Cl. ..... 209/315; 209/99; 209/394

[51] Int. Cl.[2] ..... B07B 1/28

[58] Field of Search ..... 209/233, 392, 393, 394, 209/99, 314, 257, 311, 315

[56] References Cited

UNITED STATES PATENTS

| | | | |
|---|---|---|---|
| 363,084 | 5/1887 | Riggs | 209/393 |
| 425,705 | 4/1890 | Smallwood | 209/99 |
| 447,029 | 2/1891 | Hallowell | 209/257 X |
| 724,785 | 10/1903 | Graham | 209/99 |
| 757,676 | 4/1904 | Pierce | 209/99 X |
| 864,894 | 9/1907 | Munnicutt | 209/394 |
| 1,325,505 | 12/1919 | Bong | 209/394 |
| 1,366,130 | 1/1921 | Mueller | 209/99 |
| 1,956,507 | 4/1934 | Johnson | 209/394 |
| 2,829,768 | 4/1958 | Hughes | 209/99 |
| 3,059,771 | 10/1962 | Turdo | 209/99 |
| 3,642,133 | 2/1972 | Venonzehi | 209/314 X |

FOREIGN PATENTS OR APPLICATIONS

| | | | |
|---|---|---|---|
| 585,863 | 12/1924 | France | 20/99 |
| 592,573 | 5/1925 | France | 209/393 |

*Primary Examiner*—Robert Halper
*Attorney, Agent, or Firm*—Steinberg and Blake

[57] ABSTRACT

The herein-disclosed vibrating screen pertains to equipment used in the mining industry for a preliminary size-grading of lump material (mineral product).

The screen has a material feeder, a sized material conveyer and a working member, all said components being mounted on a common frame.

The working member is composed of two solid plates mounted on frame supports and given a oscillating motion from vibrators, whereby the material being handled is classified into size fractions.

The plates make up an angle with each other so that an aperture is defined between the bottom edges thereof for the fractions of the material being sized to pass therethrough, while the oversize (plus material) on the plates is caused to move therealong by virtue of vibrating motion performed by the plates, to get onto the conveying device.

17 Claims, 8 Drawing Figures

VIBRATION SCREEN

The present invention relates generally to equipment used in the mining industry for a preliminary size-grading of lump mineral product, and more specifically to vibrating screens.

One prior-art vibrating screen is known to comprise a device for feeding the material being sized, a device for conveying the sized material, the frame with supports and shock-absorbers on which is mounted the working member adapted to classify the material being handled into size fractions, and the vibrator imparting to the working member an oscillating motion under the effect of which the material is separated into size fractions and transferred over the working member.

The working member of such a screen is made as a box with a number of metal grates spaced some distance apart across the width thereof. The screen box is mounted on shock-absorber type supports, the shock-absorbers being made as springs, which supports are mounted on the screen frame or immediately on the foundation. The inertia-type unbalanced-mass vibrator is mounted on the screen box, said vibrator being rotated from an electric motor through the V-belt drive. The unbalanced-mass vibrator imparts rotary oscillations to the screen box.

Provision of rigid and heavy screen-box grates, supports on which they are mounted, and the unbalanced-mass vibrator of a considerable energy, is responsible for too heavy a weight of the screen oscillating parts and, consequently, for high dynamic loads acting upon the shock-absorbers and the foundation. To prevent destruction of the structure upon which screens are installed, there must be made large-mass and size foundations which involves much capital investments.

Besides, necessity arises in the course of material screening to separate therefrom the fractions of a definite lump size. However, in the now-existing constructions of vibrating screens the grate-to-grate distance is invariable and, therefore, if such need be the case, the entire working member has to be replaced with another one which takes much time and, consequently involves some extra expenses.

It is an essential object of the present invention to provide a vibrating screen that, due to an improvement in the working member thereof, is simple in construction and reliable in operation, featuring small weight and high throughput capacity.

According to this and other objects in a vibrating screen, there is a device for feeding the material being sized into the working member which rests upon the frame supports mounted on shock-absorbers and is imparted oscillating motion from a vibrator so as to classify the material being handled into size fractions and transfer the latter towards the device for conveying the sized material toward which device the working member is inclined. According to the invention the working member is constituted by at least one pair of solid plates which are mounted on supports at an angle to each other so as to form an aperture between the bottom edges of said plates arranged at the same level, for the fractions of the material being sized to pass therethrough.

Provision of the working member as two solid plates renders it possible to reduce its weight and, accordingly, the screen oscillating mass due to the fact that only said plates are involved in oscillating motion which, in turn, decreases the power input of the vibrator drive motor.

The reduced oscillating mass of the screen results in reduced dynamic loads exerted upon the shock-absorbers and, consequently, makes it possible to simplify the construction thereof and dispense with special foundation or large-mass bases. Besides, the use of solid plates as the working member of the screen accounts for a simple construction and reliable operation thereof. Furthermore, smooth surface of the solid plates and their inclined position with respect to each other conduces to more rapid forwarding of the material therealong and ensures that the whole amount of the material being sized makes its way into the aperture between the plates, thus enabling high coefficient of its sizing into fractions and increasing the screen throughput capacity.

Moreover, the invention is characterized by the fact that the plates are so mounted on the supports with respect to each other that the aperture width increases towards the slope of the working member. Such an arrangement of the plates enables the grading of the material being handled into a few size fractions with the oscillating mass and screen height remaining unaffected.

The invention is characterized also by the fact that the plates are vertically tiltable on their supports so as to change the angle therebetween. This enables material classifying into a few fractions without increasing screen floor plan dimensions with the oscillating mass thereof being reduced.

The invention is characterized also in that, with a view to tilting the plates, at least one of the plate supports is made of two pivotably interconnected portions on one of which the plate is mounted and provision is made for a perforated segment, while the other portion of the support rests upon the frame and is provided with a pin adapted to engage one of the holes in the perforated segment.

Such a constructional feature of the supports makes it possible to substantially cut down the production and installation costs of the vibrating screen involved. Besides, said feature ensures that the whole amount of the material under classification be passed over the inter-plate aperture whatever its physico-mechanical properties, this being attained by appropriately varying the angle of tilt of the plates, and that the fraction of a required size be separated from the material under process.

The invention is characterized also in that the portion of the support which rests upon the frame has a screw, while a threaded hole is made in the frame for said screw to turn in or out so as to move said support portion along the frame, thereby varying the width of the aperture between the plates. This feature enables a setup adjustment of the aperture width prior to commencing screen operation in order that a fraction of the required size be passed through the working member aperture which considerably reduces the number of vibrating screens involved in separating definite size fractions from the material under classification.

The invention is characterized also in that provision is made under the pair of solid plates for some additional pairs of such plates which are set at an angle to each other and spaced somewhat apart so that an aperture is established between the bottom edges thereof, the width of which is diminished progressively from pair to pair of plates, while the aperture of all the pairs of plates define a through passageway narrowing from above downwards for the material to pass therealong with the simultaneous separation from said material the size fractions corresponding to the aperture of said pairs of plates. Thus, the material under process is enabled to be sized into several fractions with the same dimensions of the vibrating screen and reduced oscillating mass thereof.

The invention is characterized also in that stops are provided on the underside of the plates, adapted to interact with stops made on the supports to keep the plates mounted on the latter from being dislodged therefrom. Such a positioning of the plates on the support renders the construction of the working member much simpler and makes possible a quick replacement of the plates without dismantling the whole of the vibrating screen which adds much the service life thereof.

The invention is characterized also by the fact that the vibrators are fixed to the plates and shock-absorbers are interposed between the stops of the plate and of the support. Provision of an individual vibrator for each plate makes it possible to select the most effective oscillating conditions (i.e., disturbing force, oscillation frequency and amplitude) for the plates depending upon physico-mechanical properties of the material being classified.

Positioning of the shock absorbers between the stops of the plates and of the support precludes dynamic loads arising from vibrations of the plates, from being translated to the screen frame and foundation, whereby both of them may be made lighter in weight and more reliable.

According to one of the embodiments of arranging the pairs of the plates in the screen working member, each support is made as a cheek provided with shelves or flanges arranged one under the other and adapted to mount one of the plates of the respective pairs thereon, said cheek being pivotably mounted with its one end on a bracket provided on the frame, while the other end thereof is spring-connected to the frame, said bracket being horizontally traversable along the frame to vary the angle of tilt of the plates in each pair.

According to another embodiment of arrangement of the pairs of plates in the screen working member, each support is made as a cheek carrying the vibrator and shelves or flanges located one under the other and mounting one of the plates of the respective pair, each cheek having the screw and being connected to the frame through the shock-absorbers, the frame having the hole for said screw to accommodate, which screw, when being turned in or out, causes the cheek to move, thus varying the width of the aperture between the plates in each of the pairs.

The invention is characterized also by the fact that the shelves or flanges are spaced apart on the cheeks at a distance progressively decreasing from above downwards. Such an arrangement of the flanges allows of reducing the overall height of the vibrating screen.

It is expedient that, to reduce the weight of the screen working member, its dimensions and cost, the solid plates be made narrowed towards the direction of material traversing therealong, and that each plate of the next pair be less in width than that of the precedent pair.

Thus, the proposed vibrating screen is simple in construction, has small weight and dimensions, is reliable in operation and features high throughput capacity. The construction of the working member of said screen enables the aperture width to be controlled in the course of operation within a minimum lapse of time. Moreover, the proposed vibrating screen requires no special foundation and can therefore find most extensive application in:

mechanical ore sorting both in daylight and in underground conditions;

separating large-sized lean ore fractions to upgrade commercial ore;

sizing quarried building stone;

separating boulders when mining placer deposits;

preparing lime for roasting;

preparing ore for smelting;

separating ore fine fractions before feeding ore for crushing;

size grading of vegetables or fruits.

In what follows the invention is illustrated in a disclosure of a specific exemplary embodiment of a vibrating screen to be read in conjunction with the accompanying drawings, wherein.

Figure 1:
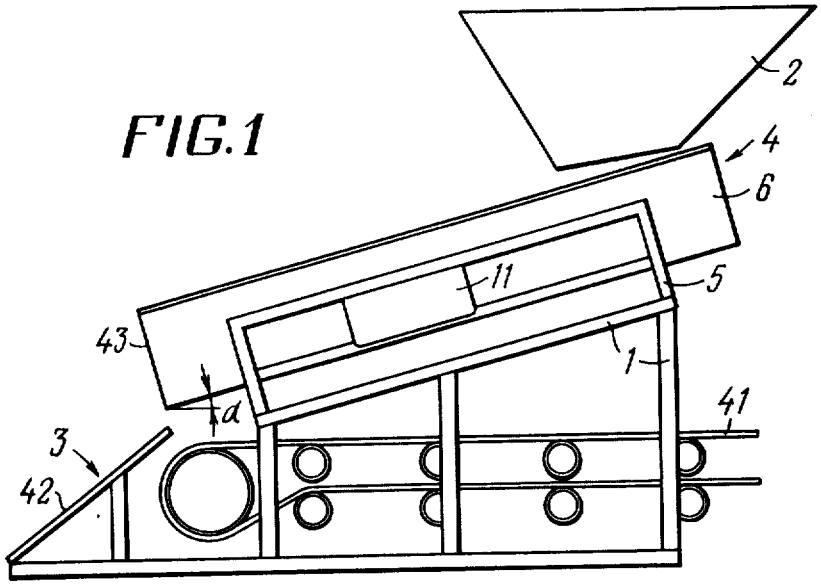
FIG. 1 is a general schematic side view of a vibrating screen, according to the invention.

Now referring to the accompanying drawings, the vibrating screen under consideration comprises a frame (FIG. 1) on which are mounted a device 2 for feeding the material being classified, a device 3 for conveying the classified material, a working member 4 fitted on supports 5 of the frame 1 and inclined towards the conveying device 3 at an angle $\alpha$ equal to 5°–25°.

The device 2 for feeding the material being classified is made as a hopper having a discharge door under which is located the working member 4 adapted to separate the material under classification into size fractions and transferring the latter to the conveying device 3.

The working member 4 is constituted by two solid plates 6 made of metal, plastics or some other materials and having a smooth surface, said plates having a length much in excess of their thickness. The plates 6 are set at an angle $\beta$ (FIG. 2) to each other, said angle being selected to range from 90° to 180° depending upon the physico-mechanical properties of the material being classified, and are spaced somewhat apart so that an aperture or gap 8 is defined between bottom edges 7 of the plates 6 for the fraction of the material being sized to pass through said aperture. Besides, the plates 6 are so mounted on the supports 5 with respect to each other that their bottom edges are located at the same level and a width D (FIG. 3) of the aperture 8 between the plates 6 remains constant throughout its length.

Figure 4:
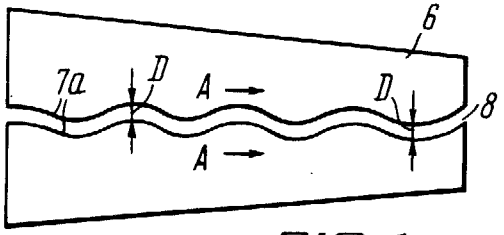
FIG. 4 shows another embodiment of the configuration of said aperture and of said plates.

To enlarge the effective cross-sectional area of the aperture 8 the latter may be formed by wavy edges 7*a* ( (FIG. 4) of the plates 6.

Figure 5:
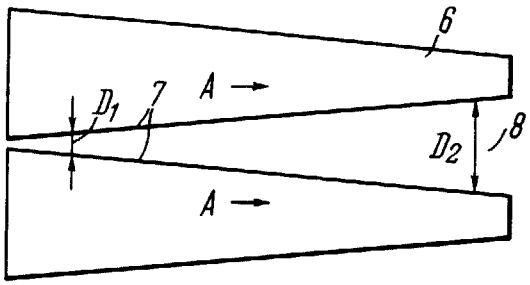
FIG. 5 shows still another embodiment of the configuration of said aperture and of said plates.
Figure 6:
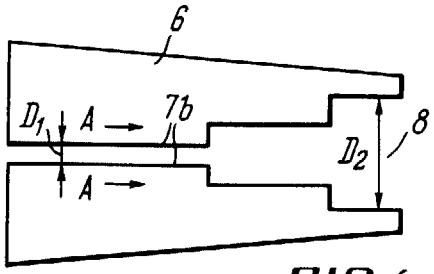
FIG. 6 shows yet still another embodiment of the configuration of said aperture and of said plates.

Besides, with a view to material separating into several size fractions, the plates 6 may be set with respect to each other that the width of the aperture 8 (FIG. 5) increases in the direction of material movement along the plates, indicated by the arrows A in the drawing from $D_1$ to $D_2$ either uniformly and progressively over the entire length of the aperture 8 or in steps as shown in FIG. 6. The stepwise broadening aperture 8 is formed by stepped edges 7*b* of the plates 6.

The plates 6 (FIG. 2) rest upon the supports 5 loosely, being kept against dislodging by stops 9 and 10, the stops 9 being provided on the undersize of each plate 6, while the stops 10 are on the support 5.

Provided on the underside of each plate 6 is also a vibrator 11 adapted to impart oscillating motion to said plate, under the effect of which motion the material being classified is sized into fractions and the latter are moved over the plate surface towards the aperture 8 and the conveying device 3.

As the vibrators 11 use may be made of any self contained unit of conventional design suitable for producing oscillating motion, such as electromechanical, electromagnetic, pneumatic or hydraulic structures.

To diminish dynamic loads arising from vibrations of the plates 6 in the course of operation of the vibrating screen, shock-absorbers 12 are interposed between the support 5 and the plates 6, in the capacity of which use is made of rubber inserts. The shock-absorbers 12 are positioned between the stops 9 and 10 so that the stops interact through the shock-absorbers 12, thus preventing the plates and the shock-absorbers from being displaced over the support 5 and oscillating motion from being translated to the support 5 and the frame 1.

To accelerate material movement along the plates 6 towards the aperture 8, the plates 6 are mounted on the supports 5 so as to be vertically tilted to alter the angle $\beta$ therebetween. To this end, one of the supports 5 or the both of them are made of two portions 13 and 14 interconnected through a hinge pivot 15, the portions 13 accommodating the plates 6 held against displacement thereover by the shock-absorbers 12 and the stops 9 and 10, while the portions 14 rest upon the frame 1.

Each of the portions 13 is provided with a segment 16 having holes 17 arranged one under another, while each of the portions 14 has a post 18 with a pin 19 fitted in a hole thereof, said pin being adapted to be received in one of the holes 17 in the segment 16. To vary the angle B between the plates 6, the pin 19 is disengaged from the holes of the segment 16 and of the post 18, whereupon the portion 13 of the support 5 is swivelled about the hinge pivot 15 with respect to the portion 14 and fixed in position by fitting the pin 19 into an appropriate hole of the post 18 brought into register with the other respective hole 17 in the segment 16.

The plates 6 are mounted on the support 5 with a possibility of setup changing of the spacing between the edges 7 thereof, i.e., an alteration of the width of the aperture 8. To this aim the portion 14 of the support is provided with a screw 20 passing through a threaded hole made in a projection 21 of the frame 1. Turning of the screw 20 causes the portion 14 to traverse along the frame 1, thus varying the distance between the bottom edges 7, i.e., the width of the aperture 8 between the plates 6.

Figure 2:
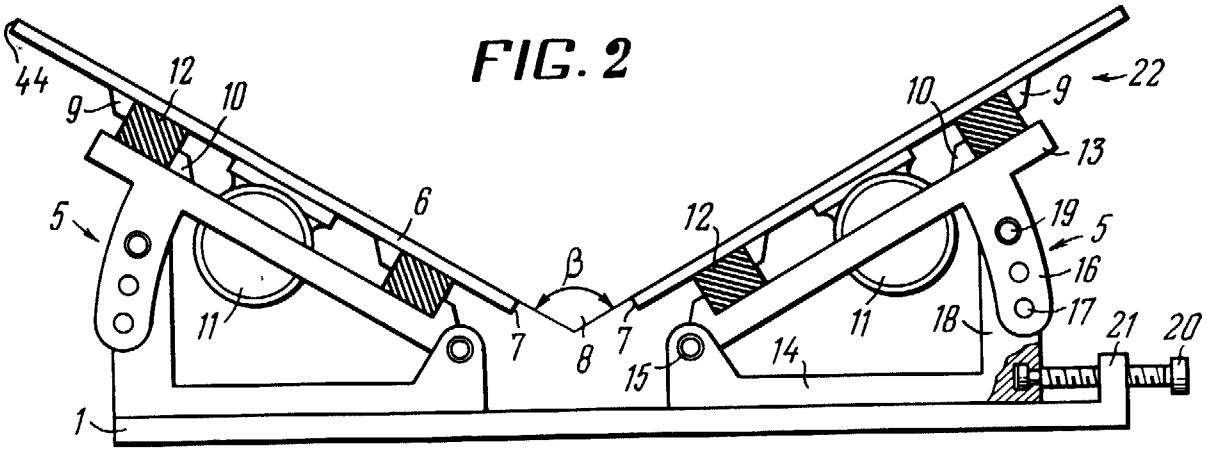
FIG. 2 is a front view of FIG. 1.
Figure 3:
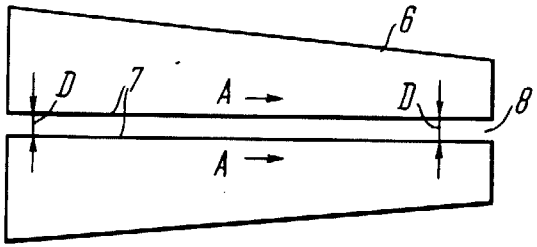
FIG. 3 shows the configuration of the aperture and of the solid plates of the screen working member, according to the invention.

The working member 4 of the present vibrating screen, as shown in FIG. 2 comprises a pair 22 of the solid plates 6.

To reduce the overall length of the vibrating screen its working member 4 (FIGS. 7 and 8), apart from the pair 22 of the solid plates 6, comprises also additional pairs 23 of solid plates 6*a* similar to the plates 6, said additional pairs 23 being located under the pair 22 and in parallel therewith. In each of the pairs 23 the plates 6*a* are set at an angle to each other and spaced somewhat apart to form an aperture 25 between bottom edges 24 thereof, each aperture between plates 6*a* of the next pair 23 (i.e., the subjacent one) having a width equal to $D_3$ which is less than the width $D_4$ of the aperture between plates 6*a* or of the plate 6 of the precedent pair 23 or 22, i.e., the superjacent one.

The plates 6*a* of the pairs 23 are so situated that the bottom edges 24 of each following pair are spaced closer to each other than those of the precedent pair, with the result that the width $D_5$ of the aperture 25 in each following pair is less than the width $D_6$ of the aperture 25 of the precedent pair 23 or 22. Thus, a through passageway 26 narrowing from above downwards is formed by the apertures 25 of the pairs 23 and by the aperture 8 of the pair 22, for the material to pass therealong with the simultaneous separation therefrom of the fractions corresponding in size to the apertures of the pairs 23.

Figure 8:
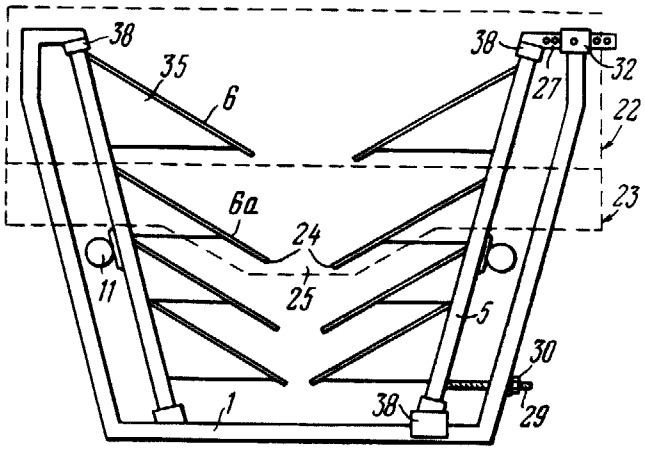
FIG. 8 shows another embodiment of arranging of solid plates in said working member.
Figure 7:
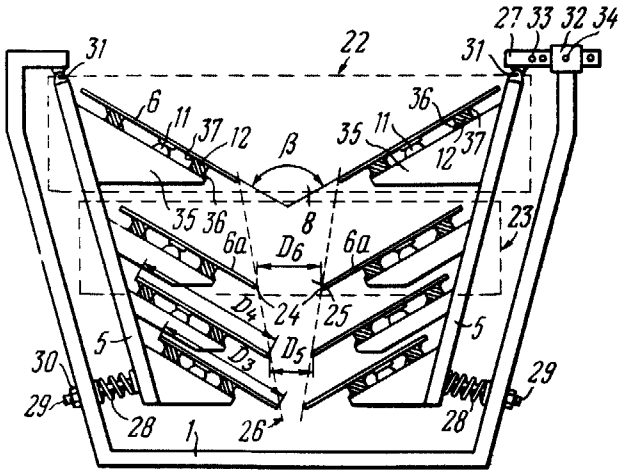
FIG. 7 shows one of the embodiments of arranging of solid plates in the screen working member.

To accommodate the plates 6 and 6*a*, the respective pairs 22 and 23 of the support 5 are made as cheeks, both or one of them being articulately suspended with one its end from a bracket 27 (as shown in FIGS. 7 and 8) mounted on the frame 1 and with its other end, connected to the frame 1 through a spring 28 and a screw 29. The screw 29 passes through the spring 28 and through the hole made in a frame 1 and is provided with a nut 30 turned thereon. Translating of the nut 30 over the screw 29 causes the cheek to swivel round a hinge pivot 31 which results in varying the angle $\beta$ between the plates in the pairs and in changing the distance between the edges 24 of the plates 6*a*, i.e., in altering the width of the apertures 25 and, accordingly, that of the through passageway 26.

The bracket 27 is mounted on the frame 1 with a possibility of horizontally traversing therealong which also makes the angle $\beta$ between the plates of the pairs 23 vary and the width of the aperture change accordingly. In view of that aim, the frame 1 is provided with a trunnion 32 which accommodates the bracket 27. Holes 33 are made in both the trunnion 32 and the bracket 27 for a pin 34 to engage said holes, thus locking the bracket 27 in said trunnion.

To vary the angle $\beta$ and the width of the apertures 25, the bracket 27 is to be shifted in the trunnion 32 and the pin 34 is to be fitted into the hole 33 of the trunnion which is aligned with the other such hole in the bracket 27.

Each cheek carries flanges 35 on which are mounted the plates 6 and 6*a* of the pair 22 and of the pairs 23, respectively.

The flanges 35 are spaced on the cheeks at a distance progressively decreasing from above downwards, while the plates 6 and 6*a* narrow towards the direction of material translation thereover, as shown in FIGS. 3 to 6.

Two embodiments of arranging the plates 6 and 6*a* on the flanges 35 are available.

According to one of these the plates 6 (FIG. 7) and 6a are freely mounted on the flanges 35 and are kept against displacing thereon by stops 36 made on the flanges 35, and stops 37 provided on the underside of the plates 6 and 6a. The stops 36 and 37 are similar to the stops 9 and 10, the shock-absorbers being positioned therebetween. Each of the plates 6a like the plates 6, carries the vibrator 11.

According to another embodiment the plates 6 and 6a (FIG. 8) are held directly by the flanges 35, and the vibrator 11 is provided on each cheek, i.e., the support 5 to impart oscillating motion to the plates 6 and 6a. To reduce dynamic loads arising from operation of the vibrator 11 each cheek with its top and bottom ends rests upon shock-absorbers 38 made as elastic shoes of which one is located on the frame 1 and the other, on the bracket 27.

To control the width of the aperture 25 one of the cheeks is provided a screw 39 engaging the hole made in the frame. The cheek is moved by rotating a nut 40 turned on the screw 39.

The classified fractions of the material being handled are removed by the conveying device 3 (FIG. 1) which incorporates a conveyor 41 and a sloping chute 42. The conveyor 41 is located under the aperture 8 of the working member 4 or under the through passageway 26 (shown in FIGS. 7 and 8), whereas the sloping chute 42 is positioned nearby the discharge end 43 of the plates 6.

Wherever the working member 4, in some embodiments, apart from the plates 6 comprises the additional pairs 23 of the plates 6a, the number of sloping chutes 42 equals the number of the pairs 22 and 23 and the chutes are arranged close to said pairs as shown in FIG. 1.

The herein-considered vibrating screen operates as follows.

The material being classified is fed from the device 2 onto the plates 6 of the screen working member 4. Upon setting the vibrator 11 into operation the plates 6 start performing an oscillating motion under the effect of which the material being handled begins moving from top edges 44 (FIG. 2) of the plates 6 towards the bottom edges 7 and at the same time is advanced along the plates in the direction of slope thereof, towards the chute 42 of conveying device 3. Under the action of the vibrating plates 6 lumps of the material different in size are transferred towards the aperture 8, and the material fractions having lumps less in size than the width of the aperture 8 fall therethrough to get onto the conveyor 41, while the fractions of the material being classified whose lumps are of greater size than the width of the aperture 8, are translated along the plates 6 and fall onto the sloping chute 42 (FIG. 1) of the device 3 for conveying the sized material.

Whenever it is necessary to separate a definite size fraction from the material being classified, the width of the aperture 8 is to be varied by resorting to the procedure set forth hereinabove, such as turning the screw 20.

To suit the variation of the physico-mechanical properties of the material being classified (i.e., increased or decreased proportion of tacky materials, bulk weight moisture content, and the like), it is necessary, for improving the process of material classifying into fractions, to vary the angle $\beta$ between the plates 6 (FIG. 2) which is carried out by having recourse to the above described process such as turning the portion 13 with respect to the portion 14 and fixing it in position by the pin 19.

The vibrating screen as shown in FIGS. 7 and 8 operates substantially similarly to the vibrating screen as shown in FIGS. 1 and 2, the sole difference being the fact that the material fractions falling through the aperture 8 get onto the plates 6a of the additional pairs 23 on which the material undergoes further sizing into still smaller fractions corresponding in size to the width of the apertures 25. The fractions of the material that move over the plates 6a and therealong are removed by means of the chutes 42 provided nearby the pairs 23.

Thus, the material being classified with a progressively diminishing lump size passes along the through passageway 26, the number of the resultant fractions of the material being classified equalling the total number of the screen pairs of plates plus one.

Whenever necessity arises in changing the size grades of the material being handled, a setup procedure must be carried out to vary the width of the apertures 8 and 25 either by simultaneously or by separately shifting the bracket 27 and the nut 30.

It will thus be seen that the classifier according to the invention includes as a minimum a pair of oppositely inclined plates having upper rear receiving ends and lower front discharge ends and defining between themselves the equivalent of a trough down which the material to be classified is adapted to advance from the upper rear receiving end toward the lower front discharge ends of the plates, the plates having distant from each other outer side edges and adjacent each other inner side edges which are lower than the outer side edges and which define between themselves a gap through which material smaller than the width of this gap is adapted to fall. A conveyer means 41 is situated beneath the gap to receive the material falling therethrough and convey this material away, while a second conveyor means 42 is situated with respect to the lower front discharge ends of the plates to receive the material which does not fall through the gap and convey the latter material away from the plates. In this way the material is classified.

Furthermore, according to the invention, a pair of vibrating means are respectively connected operatively with the plates for vibrating the pair of plates, the pair of vibrating means being connected either directly to the plates or being connected thereto, as shown in FIG. 8, by way of connecting structure which is rigidly fixed to the plates and to the pair of vibrating means 11. A support means, formed by the tiltable plates 13 of FIG. 2 or by elements 35 of FIG. 7 or frame 1 of FIG. 8 is provided for supporting the plates, while a shock-absorbing means, formed by the blocks 12 in FIGS. 2 and 7 or the blocks 38 in FIG. 8, is interposed between the plates and the support means to insulate the support means from the vibration of the plates so that the pair of vibrating means are capable of transmitting the vibrations directly to the plates without transmitting vibrations from the plates on one side of the gap to the plates on the other side of the gap and without dissipating the vibratory forces into springy or other types of supporting structures which may be included in the support means. The support means includes an adjusting means operatively connected at least to one of the pair of plates for adjusting the latter with respect to the other so as to provide adjustments such as inclination adjustments or adjustments in the width of the gap between the plates, and according to a further feature of the invention the adjusting means acts on one or both of the pair of plates through the shock-absorbing means so that in this way the adjusting means is itself insulated from the vibratory motion of the plates.

What is claimed is:

1. In a classifier for classifying solid bodies according to size, a pair of oppositely inclined plates having upper rear receiving ends and lower front discharge ends and defining between themselves a trough along which material to be classified is adapted to flow from said upper rear receiving ends toward said lower front discharge ends of said plates, said plates having distant from each other outer side edges and adjacent each other inner side edges which are lower than said outer side edges and which define between themselves a gap through which bodies smaller than the width of said gap are adapted to fall while bodies too large to fall through said gap are discharged at the front discharge ends of said plates, a pair of conveyer means one of which is situated beneath said gap and the other of which is situated beneath said front discharge ends of said plates for respectively receiving the classified material and conveying the classified material respectively away from said gap and said front discharge ends of said plates, a pair of self contained vibrating means respectively connected operatively with said plates for vibrating the latter, support means for supporting said plates, and shock-absorbing means interposed between and engaging said support means and said plates, said support means supporting said plates only through said shock-absorbing means while said pair of vibrating means are respectively connected operatively with said plates but not to said support means so that said shock-absorbing means insulates said support means from said plates and so that the vibrations of one of said plates is not transmitted to the other of said plates.

2. The combination of claim 1 and wherein said support means includes a frame and an adjusting means carried thereby for adjusting at least one of said plates with respect to the other, and said shock-absorbing means being situated between said adjusting means and said one plate for transmitting adjusting movement from said adjusting means to said one plate while at the same time insulating said adjusting means and said frame from the vibration of said one plate.

3. The combination of claim 1 and wherein said pair of vibrating means are respectively fixed directly to said plates.

4. The combination of claim 3 and wherein said support means includes a pair of supports respectively situated beneath and spaced from said plates and said shock-absorbing means including a pair of shock absorbing units respectively situated between said supports and said plates.

5. The combination of claim 4 and wherein each shock absorbing unit includes at least one shock-absorbing block with each plate and support therebeneath respectively carrying stops which engage said block, said block and stops forming the only structure by which each plate and the vibrating means fixed thereto is mounted on the support therebeneath.

6. The combination of claim 5 and wherein a mounting means pivotally mounts each support for pivotal movement about an axis parallel to a side edge of each plate, and an adjusting means connected between each support and the mounting means for adjusting the inclination of said support and for thus adjusting the inclination of said plates with respect to each other.

7. The combination of claim 6 and wherein a frame carries said mounting means and an adjusting means is connected to said frame and at least one of said mounting means for moving the latter toward and away from the other of said mounting means for adjusting the width of the gap between said plates.

8. The combination of claim 1 and wherein a plurality of said pairs of plates are situated one beneath and spaced from the other forming a series of pairs of plates progressing from an uppermost pair of plates to a lowermost pair of plates with the gaps between the inner side edges of each pair of plates becoming gradually narrower from the uppermost to the lowermost pair of plates.

9. The combination of claim 8 and wherein a plurality of said vibrating means are respectively fixed directly to all of said plates.

10. The combination of claim 8 and wherein a connecting structure is rigidly fixed to and interconnects all of the plates on one side of a vertical plane extending through all of the gaps while another connecting structure is rigidly fixed to and interconnects all of the plates on the other side of said plane, and said pair of vibrating means being respectively fixed to the connecting structures respectively situated on opposite sides of said plane so that all of the plates on one side of said plane are vibrated separately from all of the plates on the other side of said plane.

11. The combination of claim 8 and wherein the space between said pairs of plates becomes progressively smaller from said uppermost downwardly toward said lowermost pairs of plates.

12. The combination of claim 1 and wherein said gap has a uniform width.

13. The combination of claim 12 and wherein said gap is straight.

14. The combination of claim 12 and wherein said gap has a wavy configuration.

15. The combination of claim 1 and wherein said gap has at said front discharge ends of said plates a width greater than at said rear receiving ends thereof.

16. The combination of claim 15 and wherein said inner side edges of said plates are straight and diverge with respect to each other toward said front discharge ends of said plates.

17. The combination of claim 15 and wherein said inner side edges of said plates are stepped.

* * * * *